US008622116B2

(12) United States Patent
Yang

(10) Patent No.: US 8,622,116 B2
(45) Date of Patent: Jan. 7, 2014

(54) HEAT ABSORBING OR DISSIPATING DEVICE WITH MULTI-PIPE REVERSELY TRANSPORTED TEMPERATURE DIFFERENCE FLUIDS

(76) Inventor: Tai-Her Yang, Dzan-Hwa (TW)

( * ) Notice: Subject to any disclaimer, the term of this patent is extended or adjusted under 35 U.S.C. 154(b) by 1120 days.

(21) Appl. No.: 12/588,377

(22) Filed: Oct. 14, 2009

(65) Prior Publication Data

US 2010/0089556 A1 Apr. 15, 2010

Related U.S. Application Data

(63) Continuation-in-part of application No. 12/285,862, filed on Oct. 15, 2008, now Pat. No. 8,297,343.

(51) Int. Cl.
*F28D 15/00* (2006.01)
*F28F 3/14* (2006.01)

(52) U.S. Cl.
USPC ..... 165/104.11; 165/104.19; 165/104.27; 165/104.33; 165/170

(58) Field of Classification Search
USPC ..... 165/4, 45, 104.11, 104.14, 104.19, 165/104.21, 104.26, 104.27, 104.33, 170
See application file for complete search history.

(56) References Cited

U.S. PATENT DOCUMENTS 2,626,130 A * 1/1953 Raskin ..... 165/170
2,911,513 A * 11/1959 MacCracken ..... 165/104.19
3,035,419 A * 5/1962 Wigert ..... 165/104.33
3,053,514 A * 9/1962 Grenell ..... 165/170
4,120,284 A * 10/1978 Cotsworth et al. ..... 165/171
4,182,409 A * 1/1980 Robinson, Jr. ..... 165/104.11
4,219,076 A * 8/1980 Robinson, Jr. ..... 165/104.14
4,235,287 A * 11/1980 Kleine et al. ..... 165/170
4,240,405 A * 12/1980 French ..... 165/104.27
4,257,556 A * 3/1981 Skala ..... 165/104.11
4,299,275 A * 11/1981 Robinson, Jr. ..... 165/104.21
4,421,100 A * 12/1983 Yu ..... 126/618
4,466,256 A * 8/1984 MacCracken ..... 165/45
D280,544 S * 9/1985 Fukumoto ..... D23/386
D280,545 S * 9/1985 Fukumoto ..... D23/386
4,614,091 A * 9/1986 Frank et al. ..... 165/104.21
4,712,158 A * 12/1987 Kikuchi et al. ..... 361/699
4,827,735 A * 5/1989 Foley ..... 62/430
4,901,789 A * 2/1990 Hengelmolen ..... 165/4
4,921,041 A * 5/1990 Akachi ..... 165/104.14
5,219,020 A * 6/1993 Akachi ..... 165/104.26
5,695,004 A * 12/1997 Beckwith ..... 165/104.21
6,101,821 A * 8/2000 Cates ..... 62/59
6,220,337 B1 * 4/2001 Chen et al. ..... 165/104.17
7,650,932 B2 * 1/2010 Li ..... 165/104.33
8,109,324 B2 * 2/2012 Farid et al. ..... 165/104.33
8,448,876 B2 * 5/2013 Yang ..... 165/45

* cited by examiner

*Primary Examiner* — Ljiljana Ciric
(74) *Attorney, Agent, or Firm* — Bacon & Thomas, PLLC

(57) ABSTRACT

A heat absorbing or dissipating device having a multi-pipe arrangement for flowing of thermal conductive fluids having a temperature difference. The thermal conductive fluids are reversely transported by a first fluid piping and second fluid piping in parallel or substantially parallel arrangements on a same end side of the heat dissipation or absorption receiving article or space. This configuration is configured to allow the heat transference, i.e., heat absorption or heat dissipation, between the thermal conductive fluid and the heat absorbing or dissipating device.

12 Claims, 10 Drawing Sheets

HEAT ABSORBING OR DISSIPATING DEVICE WITH MULTI-PIPE REVERSELY TRANSPORTED TEMPERATURE DIFFERENCE FLUIDS

CROSS REFERENCE TO RELATED APPLICATION

This is a continuation-in part of application Ser. No. 12/285,862, filed on Oct. 15, 2008.

BACKGROUND OF THE INVENTION (a) Field of the invention

The present invention discloses a device having a multi-pipe structure configured to pass thermal conductive fluids in reverse flow directions to allow heat absorption or heat dissipation. More specifically, the multi-pipe system is disposed with at least one passage of the first fluid piping and at least one passage of the second fluid piping in parallel or substantially parallel arrangement, where the first fluid piping and the second fluid piping are arranged for transporting the thermal conductive fluids, e.g., gasses or liquids, gasses changing to liquid state, or liquids changing to gaseous state having a temperature difference, to the passive heat dissipation or absorption receiving article or space in mutually reverse directions. This arrangement produces a heat absorbing or dissipating function onto the passive heat dissipation or absorption receiving article or space thereby forming a more uniform temperature distribution on the passive heat dissipation or absorption receiving article or space.

(b) Description of the Prior Art

For the conventional heat absorbing or dissipating devices that pass thermal conductive fluid as the heat absorbing or dissipating body, such as engine cooling water radiators, heat absorbing devices utilizing thermal conductive fluid, or heat dissipating devices such as warming devices, heaters, or the warming energy transfer device, etc., as the flow direction of the thermal conductive fluid is fixed, larger temperature difference is formed at each position on the heat absorbing or dissipating body of the thermal conductive fluid.

SUMMARY OF THE INVENTION

The present invention discloses an improvement to the conventional heat transfer devices using thermal conductive fluid in fixed flow direction as the heat absorbing or dissipating body for heat absorption or dissipation by using a first fluid piping and a second fluid piping in parallel or substantially-parallel arrangement. The first fluid piping and the second fluid piping is arranged for transporting the thermal conductive fluids, which can be gasses or liquids, or gasses that change to liquid state, or liquids that change to gaseous state having a temperature difference, to the passive heat dissipation or absorption receiving article or space in mutually reverse directions. When transporting the thermal conductive fluids, a heat absorption or dissipation function is performed on the passive heat dissipation or absorption receiving article or space to create a more uniform temperature distribution.

DESCRIPTION OF MAIN COMPONENT SYMBOLS

Figure 1:
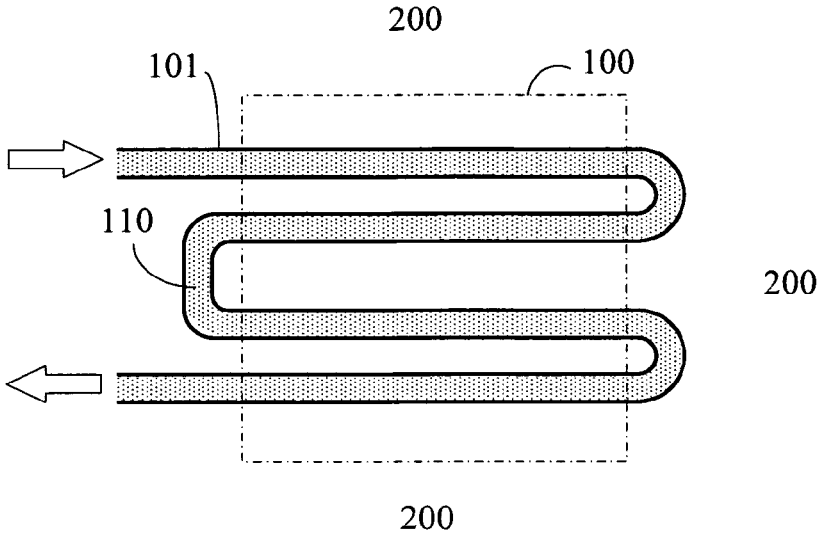
Fig. 1 (Prior Art)
FIG. 1 is a main structural schematic view of a heat absorbing or dissipating device for being passed through by thermal conductive fluid at fixed flow direction being constituted by conventional heat absorbing or dissipating gaseous or liquid state fluid or gaseous to liquid state fluid, or liquid to gaseous state fluid, etc.

100: Heat absorbing or dissipating body
100': Thermal conductive fluid passed and passively receiving heat absorbing or dissipating tubular structure body
101: First fluid piping
102: Second fluid piping
105: Inlet Manifold
106: Outlet Manifold
110: Thermal conductive fluid
111: First fluid outlet
112: First fluid inlet
121: Second fluid outlet
122: Second fluid inlet
200: Passive heat dissipation or absorption receiving article in solid, or colloid, or liquid, or gaseous state or space
300: Independent thermal conductive plate
350: Thermal conductive plate with temperature insulating slots
400: Common thermal conductive plate
500: Control device
600: Two-way movement of fluid pumping device

DETAILED DESCRIPTION OF THE PREFERRED EMBODIMENTS

FIG. 1 is a structural schematic view of a heat absorbing or dissipating device for passing thermal conductive fluids at fixed flow direction, where the thermal conductive fluid is a conventional heat absorbing or dissipating gas or liquid or gas that changes state to liquid, or liquid that changes state to gas, etc. The thermal conductive fluid (110) is passed through the first fluid piping (101) to thermally contact the heat absorbing or dissipating assembly constituted by the heat absorbing or dissipating body (100). This configuration allows: 1) the passing through of the thermal conductive fluid (110) in the first fluid piping (101) to perform cooling or heating functions by transferring the heating or cooling energy of the thermal conductive fluid through the heat absorbing or dissipating body (100) to the passive heat dissipation or absorption receiving solid, or colloid, or liquid, or gaseous state article or space (200); or 2) the passing through of the thermal conductive fluid (110) in the first fluid piping (101) to reversely absorb the surrounding cooling or heating energy of the heat absorbing or dissipating body (100). The first configuration is often applied in engine cooling water radiators, heat absorbing cooling energy discharge devices utilizing thermal conductive fluid (110), or heat dissipating warming energy discharge devices such as warming devices, heaters, evaporators, condensers, or the cooling or warming energy transfer device, etc. In this application, thermal conductive fluid (110) is inputted via the inlet of the first fluid piping (101) at one side end of the heat absorbing or dissipating body (100) and outputted via another side end to form a larger temperature difference between the inlet and outlet of the thermal conductive fluids (110) of the first fluid piping (101) of the heat absorbing or dissipating body (100). The second configuration is often applied in cooling or warming energy transfer devices. In this application, the second configuration will form a larger temperature difference between the inlet and outlet of the thermal conductive fluids (110) of the first fluid piping (101) of the heat absorbing or dissipating body (100). These configurations have the defects of the conventional heat absorbing or dissipating device.

Figure 2:
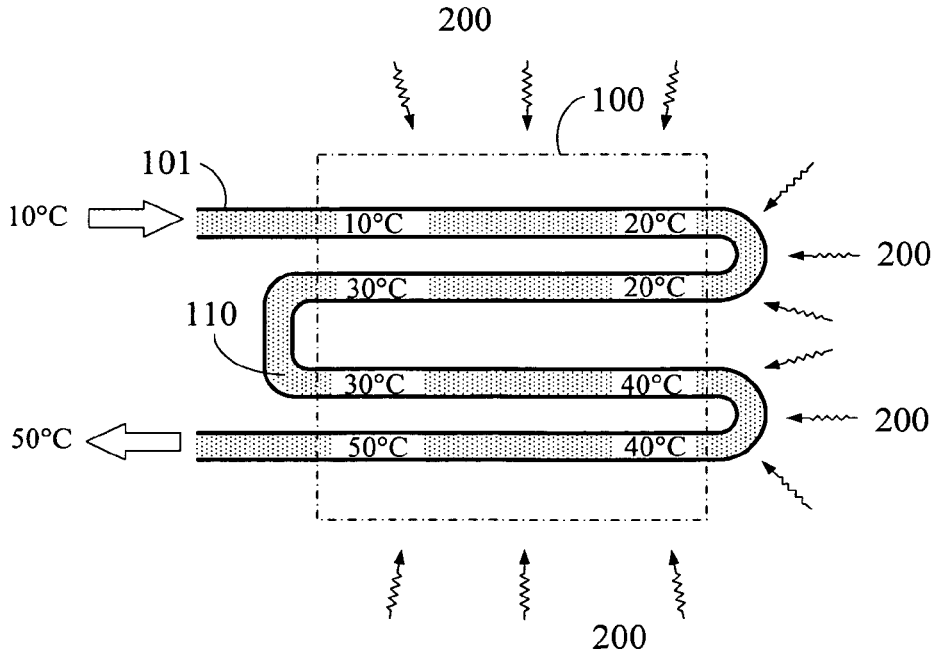
Fig. 2 (Prior Art)
FIG. 2 is a temperature difference distribution diagram of FIG. 1 being operated for the heat absorbing cooling energy discharge device function.

FIG. 2 is a temperature difference distribution diagram of FIG. 1 where the heat absorbing or dissipating body (100) has a warming function by providing heating energy to the thermal conductive fluid. FIG. 2 shows the thermal conductive fluid (110) flowing in a fixed flow direction as shown in FIG. 1 operated as having a conventional heat dissipating function where warming energy is absorbed by the thermal conductive fluid. The thermal conducive fluid flow in the piping having an unidirectional flow path, where when the thermal conductive fluid (110) passes through the first fluid piping (101), a larger difference in the temperature distribution forms between the inlet and outlet of the thermal conductive fluids (110) of the heat absorbing or dissipating body (100). In other words, as seen in FIG. 2, the temperature at the inlet of the thermal conductive fluid is 10° C. and progressively increases to an outlet temperature of 50° C. Similarly, the temperature of the heat absorbing or dissipating body (100) has a similar temperature distribution where a first end, e.g., an inlet position, has a temperature significantly lower than at a second end, e.g., an outlet position. This creates a non-uniform temperature distribution within the heat absorbing or dissipating body (100).

Figure 3:
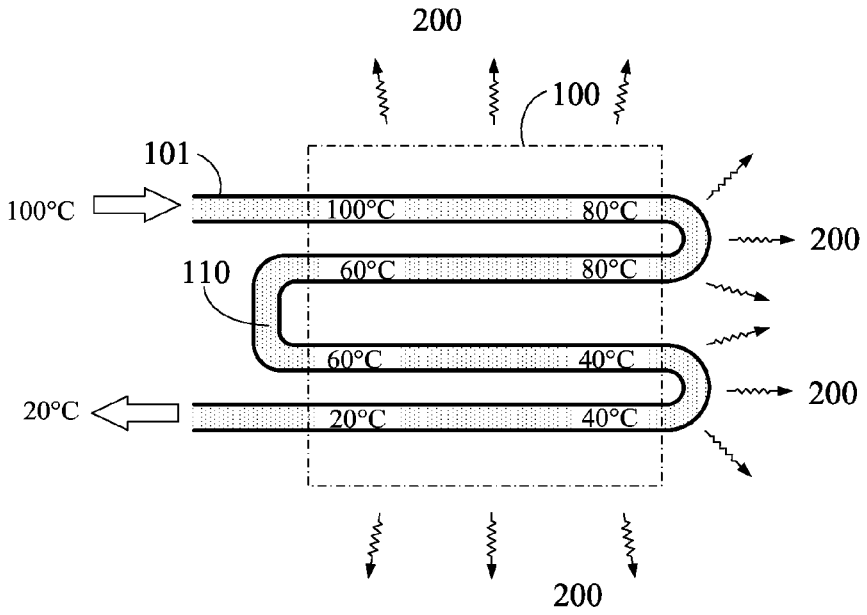
Fig. 3 (Prior Art)
FIG. 3 is a temperature difference distribution diagram of FIG. 1 being operated as the heat dissipating device.

FIG. 3 is a temperature difference distribution diagram of FIG. 1 being operated as the heat dissipating function by using a device that absorbs warming energy. FIG. 3 shows the thermal conductive fluid (110) flowing in a fixed flow direction as shown in FIG. 1 having an unidirectional flow path. The thermal conductive fluid flows in a conventional heat absorbing device that transfers heating energy to the heat absorbing or dissipating body (100) thus cooling the thermal conductive fluid. When the thermal conductive fluid (110) passes through the first fluid piping (101), a large temperature difference distribution occurs between the inlet and outlet of the thermal conductive fluid (110) of the heat absorbing or dissipating body (100). As seen in FIG. 3, the temperature of the thermal conductive fluid at the inlet of the heat absorbing or dissipating body is at 100° C., while the temperature of the thermal conductive fluid at the outlet of the heat absorbing or dissipating body is at 20° C. Since the temperature of the thermal conductive fluid is significantly higher at the inlet of the heat absorbing or dissipating body, the thermal distribution profile of the heat absorbing or dissipating body similarly has a large difference in temperature at the inlet and outlet positions, i.e., the inlet side is hotter than the outlet side.

The present invention improves over the above temperature distribution phenomenon by innovatively disclosing a device that passes thermal conductive fluids for heat absorption or dissipation using a method that pumps thermal conducive fluids in a multi-pipe structure in reverse directions to produce a heat absorbing or dissipating function to a passive heat dissipation or absorption receiving article or space. This allows the heat absorbing or dissipating thermal conductive fluid to have a more uniform temperature distribution profile.

Figure 4:
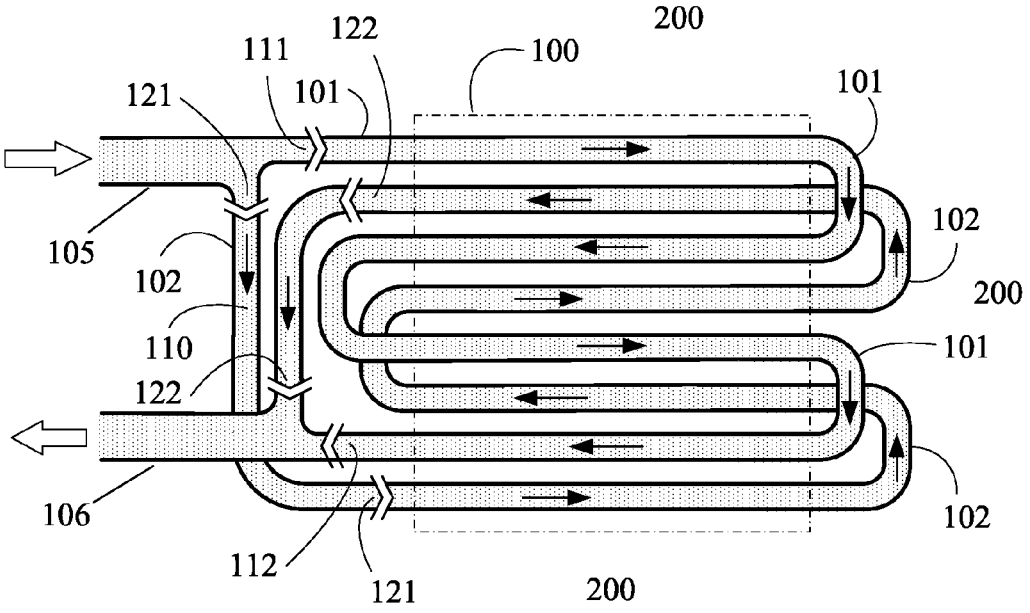
FIG. 4 is a main structural schematic view of the heat absorbing or dissipating device with multi-pipe reversely transported temperature difference fluids of the present invention.

FIG. 4 is a main structural schematic view of the heat absorbing or dissipating device with a multi-pipe structure configured in a way to allow reversely transporting the temperature difference fluids of the present invention. The assembly structure of the heat absorbing or dissipating device mainly comprises the following:

A heat absorbing or dissipating body (100) made of thermal conductive material configured to receive the thermal energy from the thermal conductive fluid (110). The thermal conductive fluid can be in a gaseous or liquid state fluid, or can change from a gaseous to liquid state or from a liquid to gaseous state inside the first fluid piping (101) and the second fluid piping (102) to perform a heat absorbing function by absorbing warming energy or heat dissipating function by releasing warming energy to the passive heat dissipation or absorption receiving article or space (200). Additionally, there can be one or more than one of the heat absorbing or dissipating bodies (100).

A fluid piping (101) and a second fluid piping (102) are made of thermal conductive material to allow the reverse passing of the thermal conductive fluid (110) for transferring thermal energy to the heat absorbing or dissipating body (100). The first fluid piping (101) and the second fluid piping (102) can have one or more than one passage.

An inlet manifold (105) having a first fluid outlet (111) is connected to the first fluid piping (101) in parallel with a second fluid outlet (121) of the inlet manifold connected to the second fluid piping (102) to receive the inflow of the thermal conductive fluid (110) and the first fluid inlet (112) of an outlet manifold (106) is connected to the first fluid piping (101) in parallel with the second fluid inlet (122) of the outlet manifold connected to the second fluid piping (102) to receive the outflow of the thermal conductive fluid (110).

The first fluid piping (101) and the second fluid piping (102) are arranged to form a first and second circuit within the heat absorbing or dissipating device in a parallel or substantially parallel configuration having a planar structure or three-dimensional structure in the heat absorbing or dissipating body (100). This structure is characterized as having the first fluid outlet (111) and the second fluid inlet (122) installed at adjacent locations to the heat absorbing or dissipating body (100), while the first fluid inlet (112) and the second fluid outlet (121) are installed at another adjacent location on the heat absorbing or dissipating body (100). In other words, the first fluid outlet is arranged on an opposite end of a first side of the heat absorbing or dissipating body than the second fluid outlet of the inlet manifold and the first fluid inlet is arranged on an opposite side of the first side of the heat absorbing or dissipating body than the second fluid inlet of the outlet manifold. This configuration allows the thermal conductive fluids (110) to flow in two circuits inside the first fluid piping (101) and the second fluid piping (102) installed on the heat absorbing or dissipating body (100) to transport the fluids in reverse directions to commonly allow a more uniform temperature distribution in the heat absorbing or dissipating body (100) for performing heat absorbing or dissipating function to the passive heat dissipation or absorption receiving solid, or colloid, or liquid, or gaseous state article or space (200). In other words, the flow of the thermal conducitve fluid through the first and second circuits is arranged so that the thermal conductive fluid is flowable in the heat absorbing or dissipating body such that the flow through the at least one first circuit is in one direction and the flow in the at least one second circuit is in a parallel and opposite direction to the one direction.

The structural relationships between the heat absorbing or dissipating body (100), the first fluid piping (101), and the second fluid piping (102) as shown in FIG. 4 can be described as having one or more one of the following relationships:

(1) The heat absorbing or dissipating body (100) has an assembled structure with at least one of the first fluid piping (101) and the second fluid piping (102);

(2) The heat absorbing or dissipating body (100) has an integral structure with at least one of the first fluid piping (101) and the second fluid piping (102);

(3) The function of the heat absorbing or dissipating body (100) is directly provided with at least one of the first fluid piping (101) and the second fluid piping (102);

(4) The first fluid piping (101) and/or the second fluid piping (102) is additionally installed with independent a thermal conductive plate (300) which does not connect with the neighboring fluid piping;

(5) Common thermal conductive plate (400) connects between the neighboring fluid piping and the first fluid piping (101) and/or the second fluid piping (102); and (6) Thermal conductive plate with temperature insulating slots connects between the neighboring fluid piping and the first fluid piping (101) and/or the second fluid piping (102).

Figure 5:
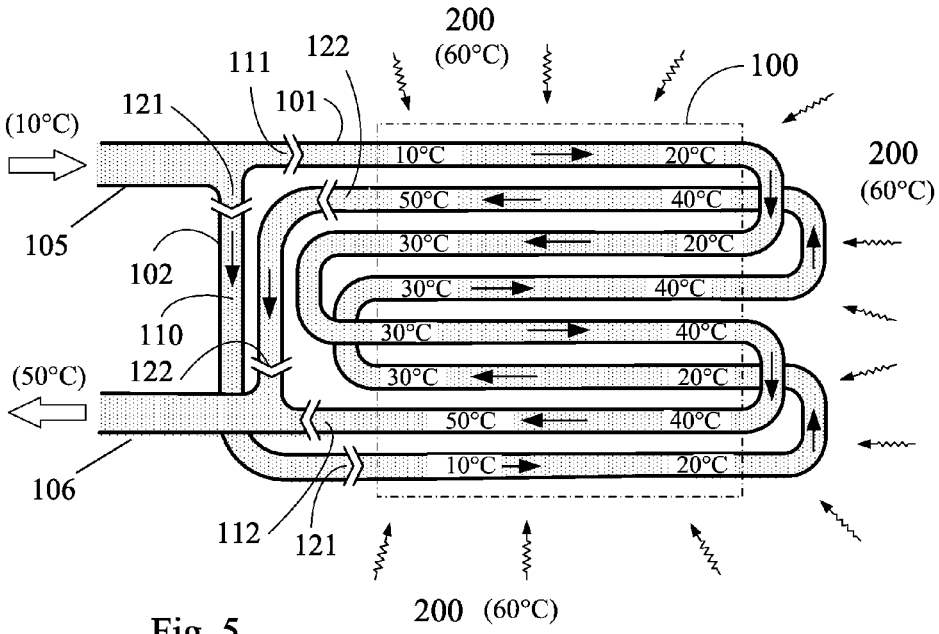
FIG. 5 is a temperature difference distribution diagram formed on the structure shown in FIG. 4 being operated for heat absorbing cooling energy discharge device function.

FIG. 5 is a temperature difference distribution diagram of the structure shown in FIG. 4 where the thermal conductive fluid absorbs warming energy from the heat absorbing or dissipating body (100) or the passive heat dissipation or absorption receiving article or space (200). As shown in FIG. 5, in the heat absorbing or dissipating body (100), the first fluid outlet (111) of the inlet manifold (105) and the second fluid inlet (122) of the outlet manifold (106) are installed in adjacent first positions. While the first fluid inlet (112) of the outlet manifold (106) and the second fluid outlet (121) of the inlet manifold (106) are installed in adjacent second positions at another location. These configurations allow the transporting of the thermal conductive fluids (110) in the two circuits in reverse directions, where the input flow of the thermal conductive fluid (110) has a lower temperature, while the output flow of the thermal conductive fluid (110) has a higher temperature, and the heat absorbing or dissipating body (100) has an intermediate temperature above the temperatures of the input and output flows of the thermal conductive fluid (110). However, the heat absorbing or dissipating body (100) has a more uniformly distributed temperature distribution resulting from absorbing or dissipating the heating and cooling energy onto the passive heat dissipation or absorption receiving article or space (200) to avoid localized low temperatures.

Figure 6:
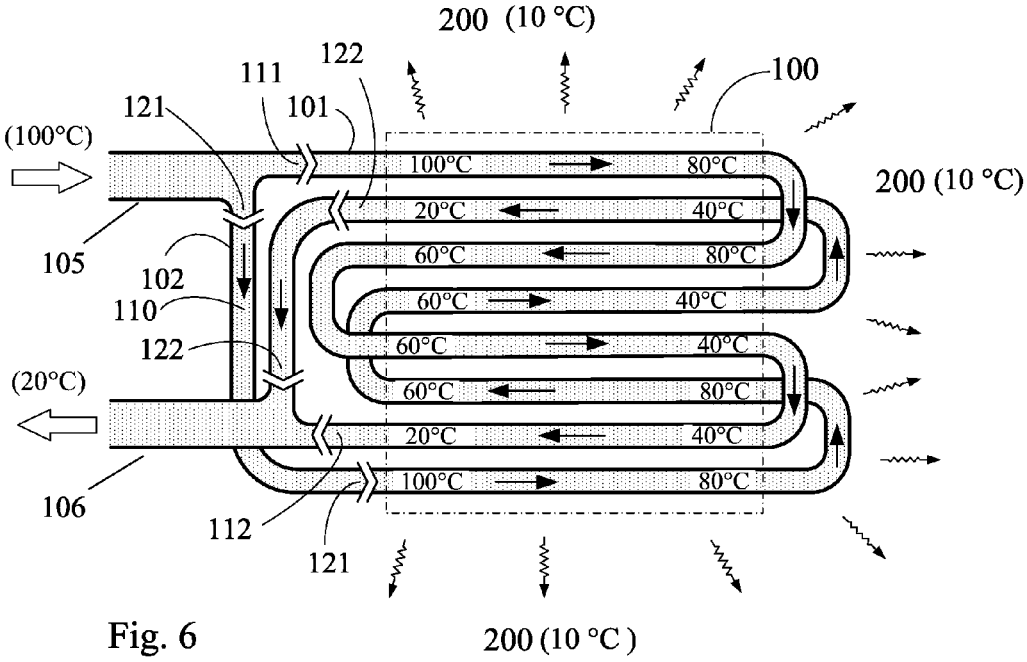
FIG. 6 is a temperature difference distribution diagram formed on the structure shown in FIG. 4 being operated as a heat dissipating device.

FIG. 6 is a temperature difference distribution diagram of the structure shown in FIG. 4 configured in a way to allow for heat dissipation of the warming energy. As shown in FIG. 6, in the heat absorbing or dissipating body (100), the first fluid outlet (111) of the inlet manifold (105) and the second fluid inlet (122) of the outlet manifold (106) are installed in adjacent first positions, while the first fluid inlet (112) of the outlet manifold (106) and the second fluid outlet (121) of the inlet manifold (105) are installed in adjacent second positions at another location. These configurations allow the transportation of the thermal conductive fluid (100) in the two circuits in reverse directions. The input flow of the thermal conductive fluid (110) has a higher temperature, while the output flow of the thermal conductive fluid (110) has a lower temperature, and the heat absorbing or dissipating body (100) has an intermediate temperature below the temperatures of the input and output flows of the thermal conductive fluid (110). However, the heat absorbing or dissipating body (100) has a more uniformly distributed temperature distribution resulting from the heat dissipating and absorbing of warming energy onto the passive heat dissipation or absorption receiving article or space (200) to avoid localized high temperatures.

In the heat absorbing or dissipating device having the multi-pipe system for reversely transporting thermal conductive fluids having a temperature difference, the first fluid piping (101) and the second fluid piping (102) can be arranged to have a parallel or substantially parallel distribution in a planar structure or three-dimensional structure to form the structural body. The first fluid piping (101) and the second fluid piping (102) is arranged to directly reversely transport the thermal conductive fluid (110) from the same end side thereby allowing the first fluid piping (101) and the second fluid piping (102) to directly transfer a heat dissipating function by thermally transferring warming energy or heat absorbing function by transferring cooling energy on the passive heat dissipating or absorption receiving article or space.

Figure 7:
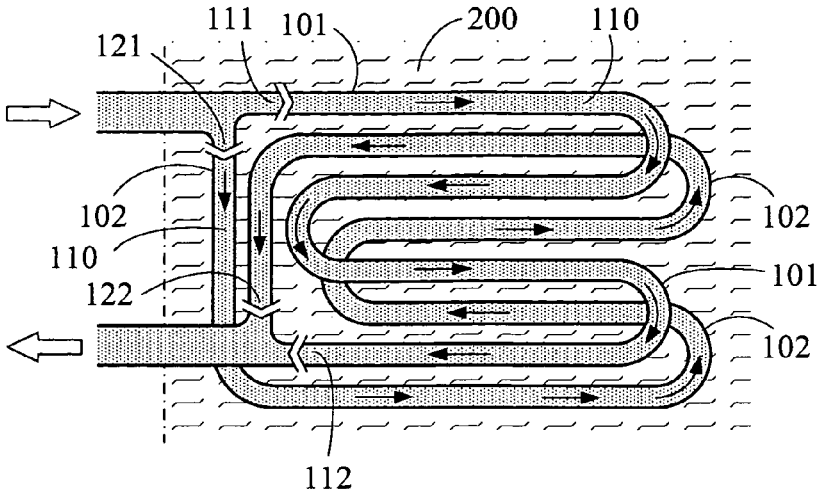
FIG. 7 is a main structural schematic view of the structure shown in FIG. 4 showing that the first fluid piping and the second fluid piping for directly reversely transporting thermal conductive fluids in temperature difference by multi-pipe directly constitute the common structural body and directly transfer thermal energy onto the passive heat dissipation or absorption receiving article or space.

FIG. 7 is a main structural schematic view of the structure shown in FIG. 4 showing the first fluid piping and the second fluid piping for directly reversely transporting thermal conductive fluids to achieve a temperature difference using a multi-pipe system as the structural body and directly transferring thermal energy to the passive heat dissipation or absorption receiving article or space. The structure of FIG. 7 further has the following features:

A fluid piping (101), Second fluid piping (102) are made of thermal conductive material that form the common structural body for transferring thermal energy through the thermal conductive fluid (110), wherein the first fluid piping (101) and the second fluid piping (102) can have one or more flow circuits. The first fluid outlet (111) of the inlet manifold (105) is connected in parallel with the second fluid outlet (121) of the inlet manifold (105) to receive inflow of the thermal conductive fluid (110), and the first fluid inlet (112) of the outlet manifold (106) is connected in parallel with the second fluid inlet (122) of the outlet manifold (106) to receive outflow of the thermal conductive fluid (110). The first fluid piping (101) and the second fluid piping (102) are configured so that they have a parallel or substantially parallel arrangement in a planar structure or three-dimensional structure to form the common structural body. The first fluid outlet (111) and the second fluid inlet (122) are installed at an adjacent first location that is common to their position in the structural body, while the first fluid inlet (112) and the second fluid outlet (121) are installed on a second adjacent location at another location that is common to their position in the structural body. The first fluid piping (101) and the second fluid piping (102) of the multiple piping structure forming the common structural body is configured in a way so that the two circuits transport the thermal conductive fluids (110) in reverse directions to more uniformly distribute the temperature in the passive heat dissipation or absorption receiving article or space (200) when absorbing the heating energy or dissipating the heating energy onto the passive heat dissipation or absorption receiving article or space (200).

For the heat absorbing or dissipating device having the multi-pipe structure for reversely transporting temperature difference fluids of the present invention, the structural relationships between the passive heat dissipation or absorption receiving article or space (200), the first fluid piping (101) and the second fluid piping (102) include the following features: the function of the heat absorbing or dissipating body (100) is provided by at least one of the first fluid piping (101) and the second fluid piping (102) to perform the heat absorption or dissipation onto the passive heat dissipation or absorption receiving article or space (200), or the first fluid piping and the second fluid piping forming the multi-pipe structure configured in a way to allow the reverse flow of the thermal conductive fluids to form the common structural body and directly transfer thermal energy onto the passive heat dissipation or absorption receiving article or space (200).

Figure 8:
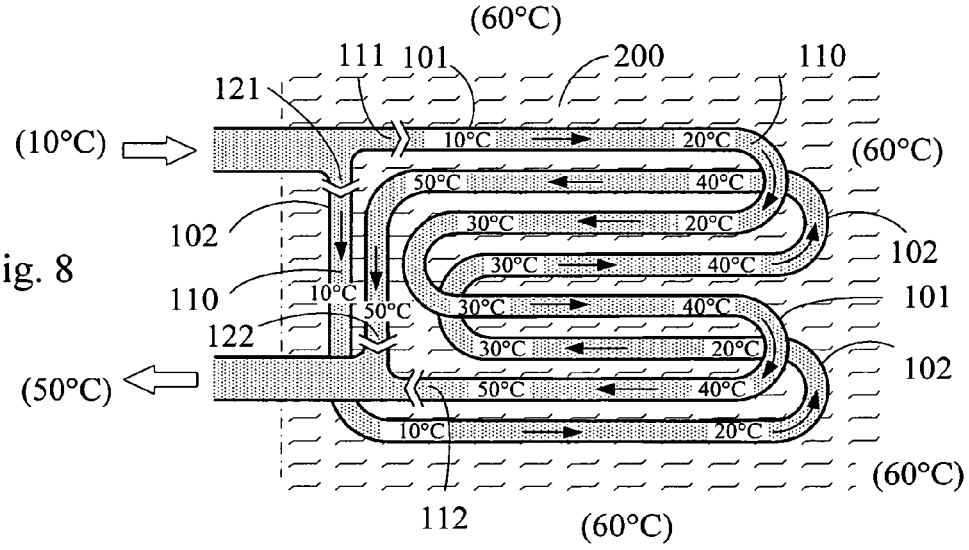
FIG. 8 is a temperature difference distribution diagram formed on the structure shown in FIG. 7 being operated for heat absorbing cooling energy discharge device function.

FIG. 8 is a temperature difference distribution diagram of the structure shown in FIG. 7, where the thermal conductive fluid absorbs warming energy from the heat absorbing or dissipating body (100) or the passive heat dissipation or absorption receiving article or space. As shown in FIG. 8, in the structural body as shown in the structure of FIG. 7, the first fluid outlet (111) of the inlet manifold (105) and the second fluid inlet (122) of the outlet manifold (106) are installed in adjacent first positions, while the first fluid inlet (112) of the outlet manifold (106) and the second fluid outlet (121) of the inlet manifold (105) are installed in adjacent second positions at another location for transporting the thermal conductive fluid flows (110) in the two circuits in reverse directions, wherein the input flow of the thermal conductive fluid (110) has a lower temperature, while the output flow of the thermal conductive fluid (110) has a higher temperature, and the common structural body has an intermediate temperature above the temperatures of the input and output flows of thermal conductive fluids (110). This configuration has a more uniformly distributed temperature distribution in the passive heat dissipation or absorption receiving article or space (200) to perform heat absorbing and cooling energy transfer onto the passive heat dissipation or absorption receiving article in solid, or colloid, or liquid, or gaseous state or space (200) thereby avoiding localized low temperatures.

Figure 9:
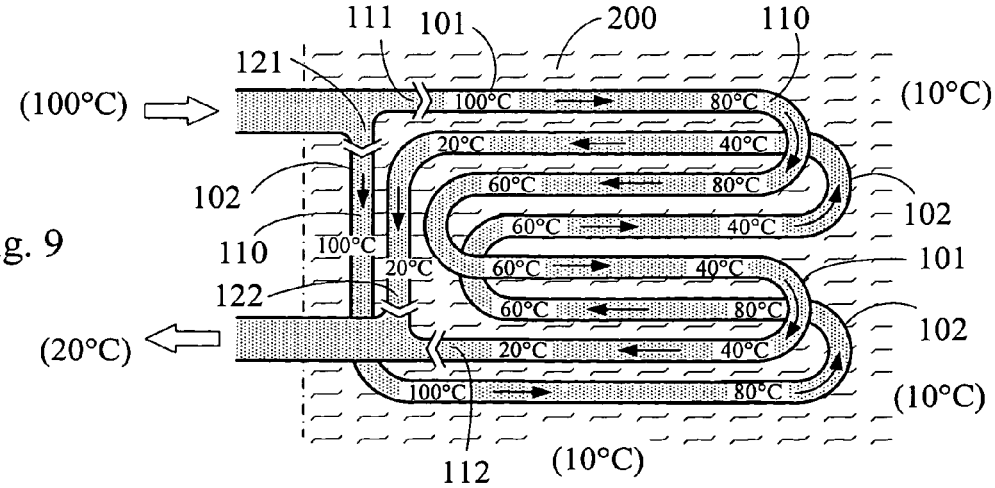
FIG. 9 is a temperature difference distribution diagram formed on the structure shown in FIG. 7 being operated as the heat dissipating device.

FIG. 9 is a temperature difference distribution diagram of the structure shown in FIG. 7, where the thermal conducive fluid dissipates warming energy to the heat absorbing or dissipating body (100) or the passive heat dissipation from the absorption receiving article or space. As shown in FIG. 9, in the common structural body as shown in the structure of FIG. 7, the first fluid outlet (111 and the second fluid inlet (122) are installed at a first adjacent position, while the first fluid inlet (112) and the second fluid outlet (121) are installed at a second adjacent position at another location for transporting the thermal conductive fluid flows (110) in the two circuits in reverse directions. The input flow of the thermal conductive fluid (110) is at a higher temperature, while the output flow of the thermal conductive fluid (110) is at a lower temperature, and the common structural body is at an intermediate temperature below the temperatures of the input and output flows of thermal conductive fluids (110). This configuration has a more uniform temperature distribution in the passive heat dissipation or absorption receiving article or space (200) to perform heat dissipating and warming energy discharge onto the passively heat dissipation or absorption receiving article or space (200) thereby avoiding localized high temperatures.

The heat absorbing or dissipating device having the multi-pipe structure configured to allow a reverse flow of the temperature difference fluids further can have the fluid inlets and the fluid outlets of the first fluid piping and the second fluid piping installed at two sides of the piping, with the same height or at different heights, respectively.

Figure 10:
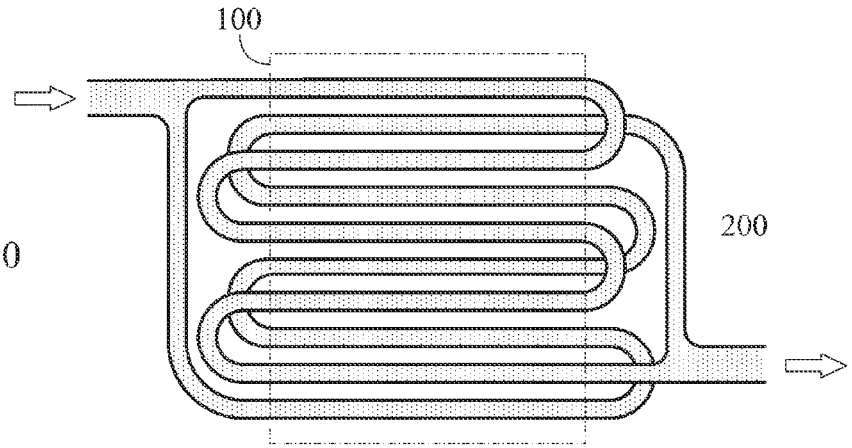
FIG. 10 is an embodiment schematic view of the structure shown in FIG. 4 showing that the fluid inlets and the fluid outlets of the first fluid piping and the second fluid piping for reversely transporting thermal conductive fluids in temperature difference by multi-pipe are installed at two sides of the piping respectively.

FIG. 10 is an embodiment of the structure shown in FIG. 4 showing the fluid inlets and the fluid outlets of the first fluid piping and the second fluid piping configured to reversely transport the thermal conductive fluids having a temperature difference using the multi-pipe structure installed at two sides of the piping respectively.

The heat absorbing or dissipating device having the multi-pipe structure configured to reversely transport the fluids having a temperature difference can further be installed with a thermal conductive heat absorbing or dissipating tubular structure body (100'), which is composed of one or more fluid piping or a structure similar to the heat absorbing or dissipating body (100), in place of the passive heat dissipation or absorption receiving article i or space (200).

Figure 11:
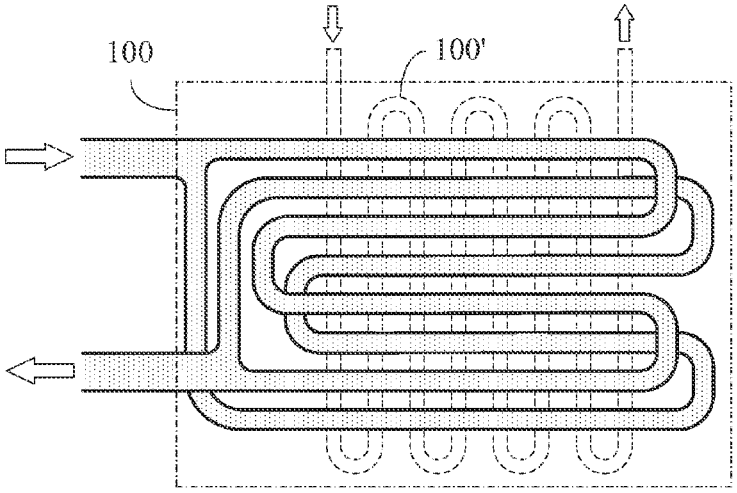
FIG. 11 is a schematic view of the embodiment shown in FIG. 4 showing that heat absorbing or dissipating body (100) combines with thermal conductive fluid passed and passively receiving heat absorbing or dissipating tubular structure body (100').

FIG. 11 is a schematic view of the embodiment shown in FIG. 4 showing that the heat absorbing or dissipating body (100) is combined with the thermal conductive heat absorbing or dissipating tubular structure body (100').

Figure 12:
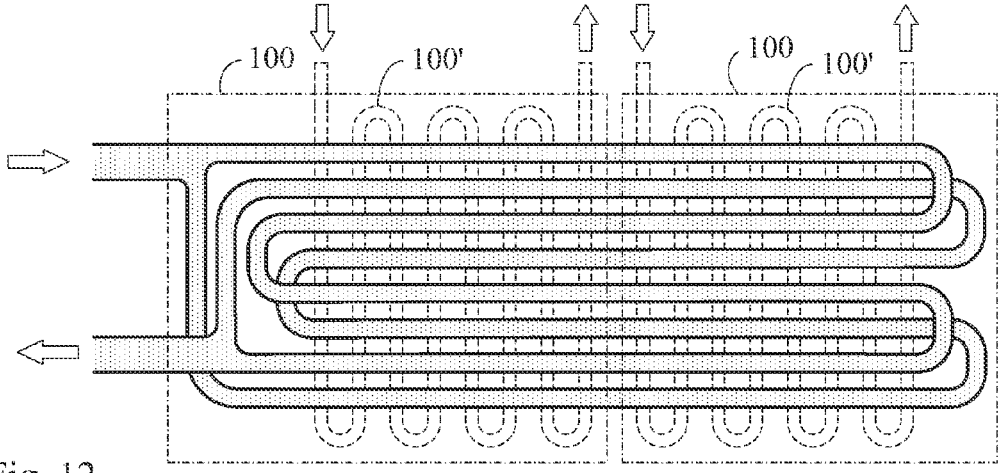
FIG. 12 is a schematic view of the embodiment shown in FIG. 4 showing that the heat absorbing or dissipating body (100) combines with a number of the thermal conductive fluid passed and passively receiving heat absorbing or dissipating tubular structure body (100').

FIG. 12 is a schematic view of the embodiment shown in FIG. 4 showing that the heat absorbing or dissipating body (100) is combined with a number of the thermal conductive heat absorbing or dissipating tubular structure body (100').

Figure 13:
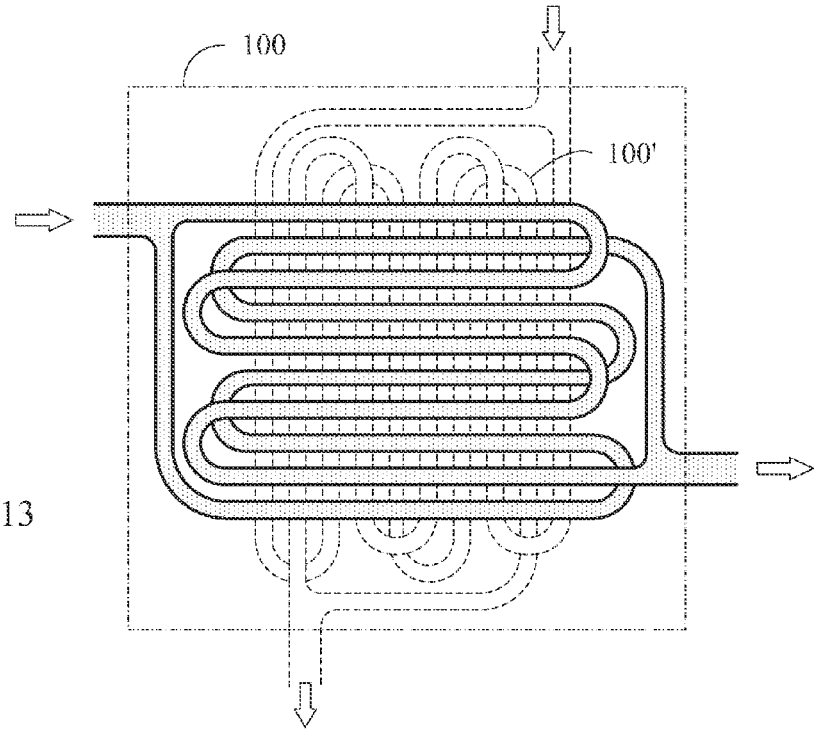
FIG. 13 is a schematic view of the embodiment shown in FIG. 10 showing that the heat absorbing or dissipating body (100) combines with the thermal conductive fluid passed and passively receiving heat absorbing or dissipating tubular structure body (100').

FIG. 13 is a schematic view of the embodiment shown in FIG. 10 showing that the heat absorbing or dissipating body (100) is combined with the thermal conductive heat absorbing or dissipating tubular structure body (100').

Figure 14:
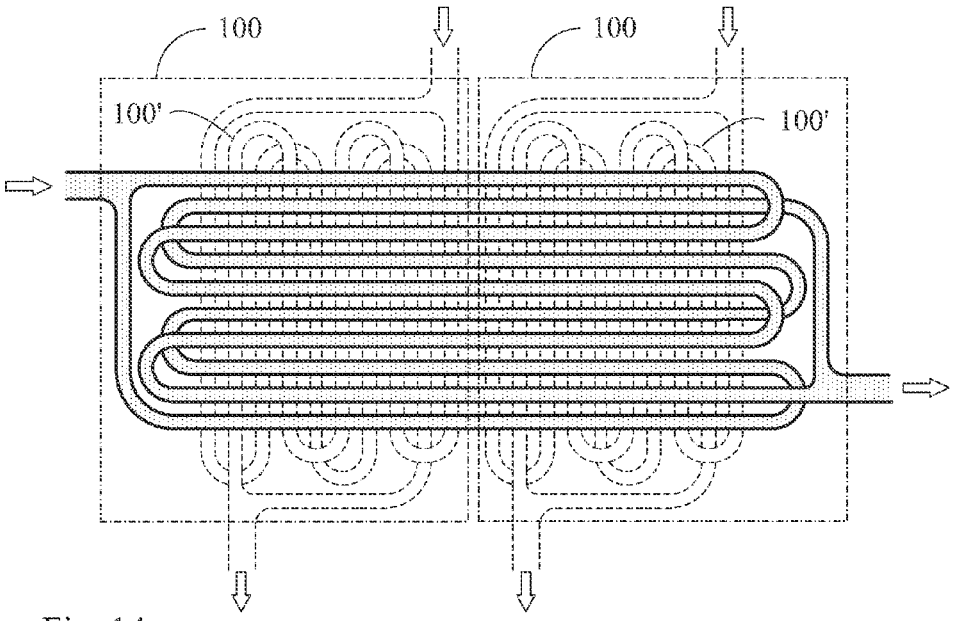
FIG. 14 is a schematic view of the embodiment shown in FIG. 10 showing that the heat absorbing or dissipating body (100) combines with a number of the thermal conductive fluid passed and passively receiving heat absorbing or dissipating tubular structure body (100').

FIG. 14 is a schematic view of the embodiment shown in FIG. 10 showing that the heat absorbing or dissipating body (100) is combined with a number of the thermal conductive heat absorbing or dissipating tubular structure body (100').

The heat absorbing or dissipating device having the multi-pipe structure configured to reversely transport fluids having a temperature difference also can be formed by the multiple pipes of the first fluid piping (101) and the second fluid piping (102), which are countercurrent to each other, sequentially staggered to transmit the energy from the thermal conductive fluid (110).

Figure 15:
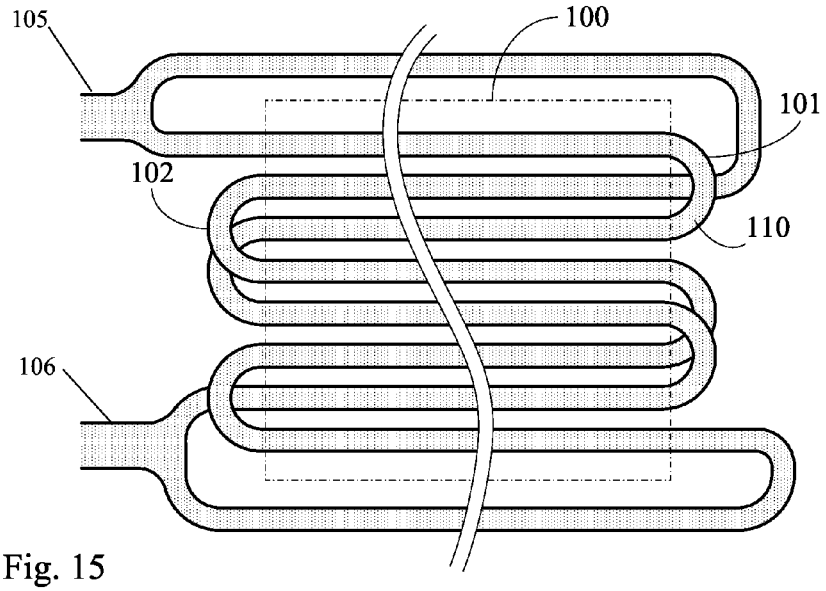
FIG. 15 is a structural schematic view of an embodiment, wherein the multiple pipes of the first fluid piping (101) and the second fluid piping (102), which are countercurrent to each other, are sequentially staggered for parallel reversely transmitting thermal conductive fluid (110), according to the present invention.

FIG. 15 is a structural schematic view of an embodiment, wherein the multiple pipes of the first fluid piping (101) and the second fluid piping (102) are connected to the inlet manifold (105) and the outlet manifold (106), which are countercurrent to each other, are sequentially staggered in a way such that the thermal energy from the thermal conductive fluid (110) is transmitted in a parallel and reverse manner.

As shown in FIG. 15, by the multiple pipes of the first fluid piping (101) and the second fluid piping (102), which are countercurrent to each other, being sequentially staggered for forming the heat absorbing or dissipating body (100), so that when the thermal conductive fluid (110) passes through the first fluid piping (101) with a flow in a first forward direction and the second fluid piping (102) with a second reverse flow direction, which are sequentially staggered, a more uniform temperature distribution will be produced at two sides of the heat absorbing or dissipating body (100). Above the first fluid piping (101) and/or second fluid piping (102) are straight pipes each pipe having single segment or curved pipes with at least one bend, and every bent segment of the first fluid piping (101) and the second fluid piping (102) are staggered in order to have mutual countercurrent flows.

The piping in the heat absorbing or dissipating device having the multi-pipe structure configured to reversely transport the fluids having a temperature difference can be additionally installed with an independent thermal conductive plate (300), and/or a common thermal conductive plate (400), and/or a thermal conductive plate (350) with temperature insulating slots to improve the absorption or dissipation of heat, where:

for further improving effects of heat absorption or dissipation, the first fluid piping (101) and/or the second fluid piping (102) can be additionally installed with an independent thermal conductive plates (300).

Figure 16:
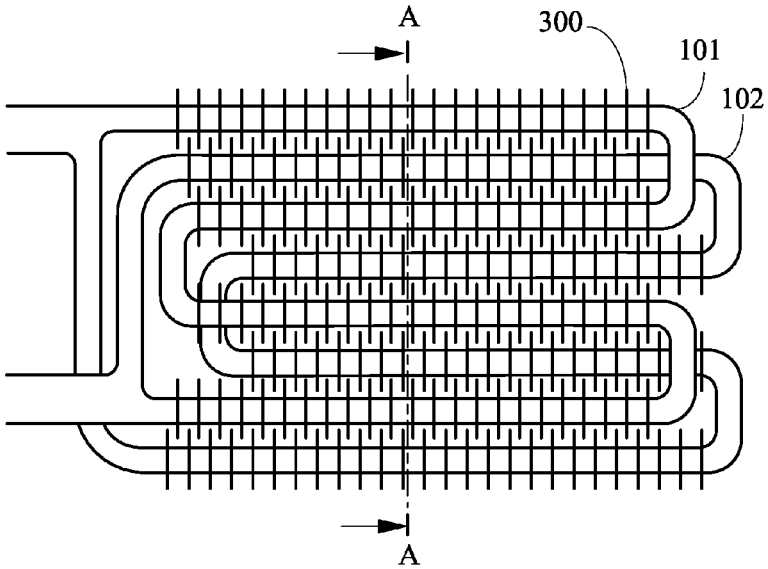
FIG. 16 is a structural schematic view of an embodiment, wherein the first fluid piping (101) and/or the second fluid piping (102) are additionally installed with independent thermal conductive plates, according to the present invention.

FIG. 16 is a structural schematic view of such an embodiment, wherein the first fluid piping (101) and/or the second fluid piping (102) are additionally installed with independent thermal conductive plates, according to the present invention.

Figure 17:
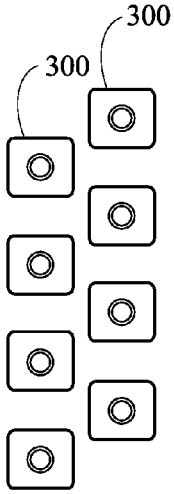
FIG. 17 is a sectional drawing of line A-A in FIG. 16.

FIG. 17 is a sectional drawing of line A-A in FIG. 16.

For further increasing heat absorption or dissipation area and enhancing structure stability, a common thermal conductive plate (400) is additionally installed between the neighboring fluid piping and the first fluid piping (101) and/or the second fluid piping (102) to improve heat absorption or dissipation.

Figure 18:
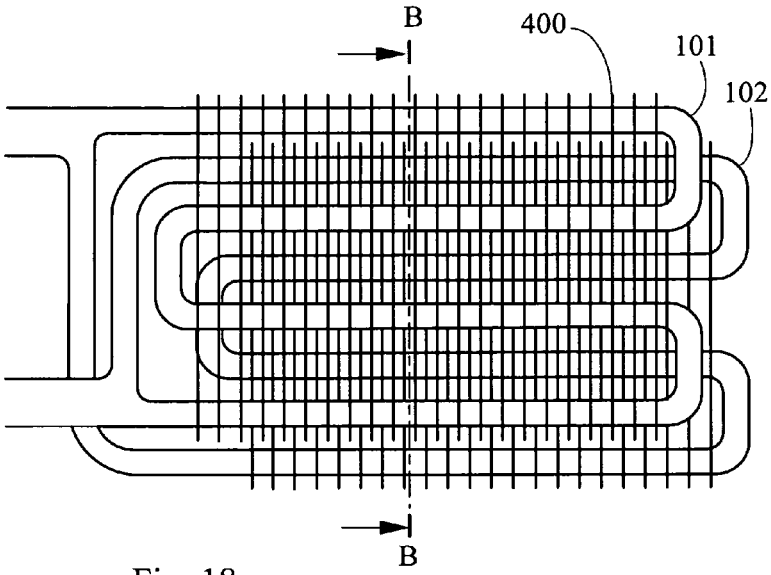
FIG. 18 is a structural schematic view of an embodiment, wherein a common thermal conductive plate is additionally installed between the neighboring fluid piping and the first fluid piping and/or the second fluid piping, according to the present invention.

FIG. 18 is a structural schematic view of such an embodiment, wherein a common thermal conductive plate is additionally installed between the neighboring fluid piping and the first fluid piping and/or the second fluid piping, according to the present invention.

Figure 19:
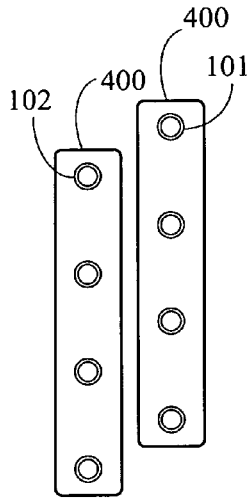
FIG. 19 is a sectional drawing of line B-B in FIG. 18.

FIG. 19 is a sectional drawing of line B-B in FIG. 18.

For increasing heat absorption or dissipation and enhancing structure stability, thermal conductive plate (350) with temperature insulating slots further can be additionally installed between the neighboring fluid piping and the first fluid piping (101) and/or the second fluid piping (102) to improve heat absorption or dissipation.

Figure 20:
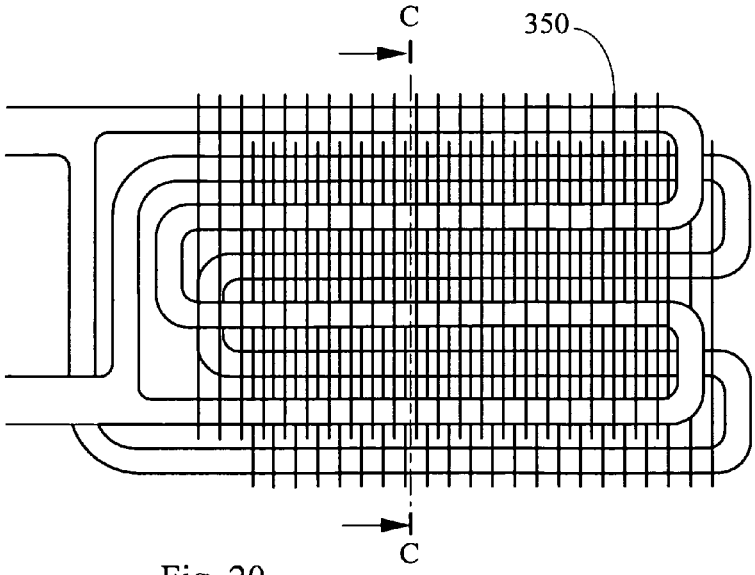
FIG. 20 is a structural schematic view of an embodiment, wherein a thermal conductive plate with temperature insulating slots is additionally installed between the neighboring fluid piping and the first fluid piping and/or the second fluid piping, according to the present invention.

FIG. 20 is a structural schematic view of such an embodiment, where a thermal conductive plate with temperature insulating slots is additionally installed between the neighboring fluid piping and the first fluid piping and/or the second fluid piping, according to the present invention.

Figure 21:
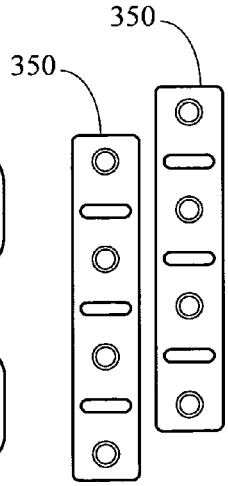
FIG. 21 is a sectional drawing of line C-C in FIG. 20.

FIG. 21 is a sectional drawing of line C-C in FIG. 20.

As the embodiment of the heat absorbing or dissipating device having the multi-pipe structure configured to reversely transport fluids having different temperatures as shown in FIG. 15, by the multiple pipes of the first fluid piping (101) and the second fluid piping (102) being sequentially staggered for forming the heat absorbing or dissipating body (100), when the thermal conductive fluid (110) passes through the first fluid piping (101) and the second fluid piping (102), which are sequentially staggered, a more uniform temperature distribution will occur at two sides of the heat absorbing or dissipating body (100). For further improving heat absorption or dissipation, the first fluid piping (101) and/or the second fluid piping (102) can be additionally installed with the independent thermal conductive plate (300) to increase the heat absorption or dissipation area.

Figure 22:
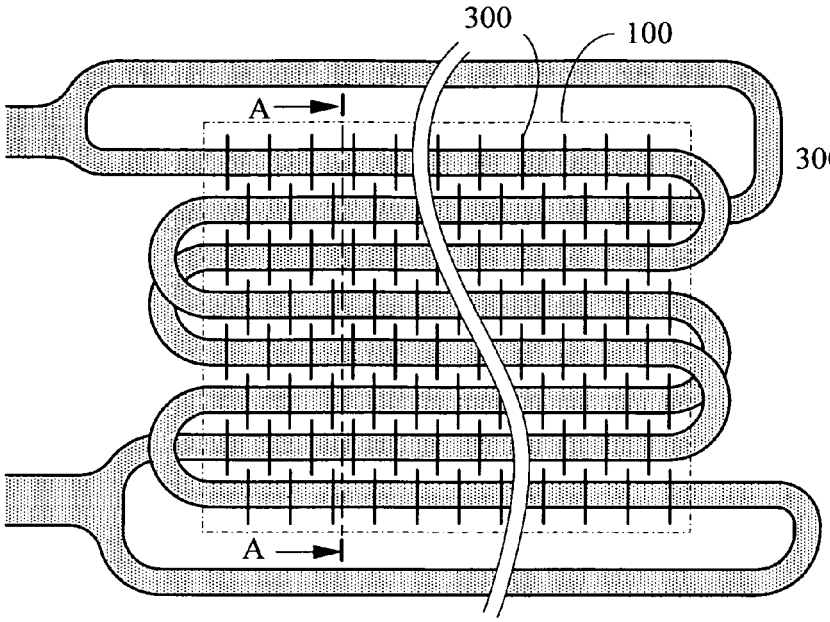
FIG. 22 is a structural schematic view of the embodiment shown in FIG. 15 showing that the first fluid piping and/or the second fluid piping are additionally installed with independent thermal conductive plates.

FIG. 22 is a structural schematic view of such an embodiment shown in FIG. 15 showing that the first fluid piping and/or the second fluid piping are additionally installed with independent thermal conductive plates (300).

Figure 23:
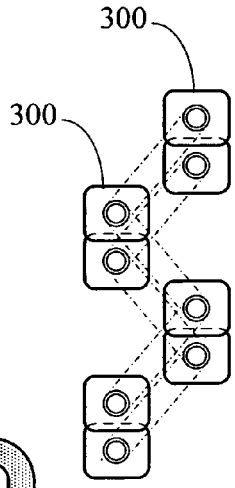
FIG. 23 is a sectional drawing of line A-A in FIG. 22.

FIG. 23 is a sectional drawing of line A-A in FIG. 22.

As the embodiment of the heat absorbing or dissipating device with multi-pipe reversely transported temperature difference fluids shown in FIG. 15, for further improving effects of heat absorption or dissipation, the common thermal conductive plate (400) is additionally installed between the neighboring fluid piping and the first fluid piping (101) and/or the second fluid piping (102) to improve heat absorption or dissipation and enhancing structural stability.

Figure 24:
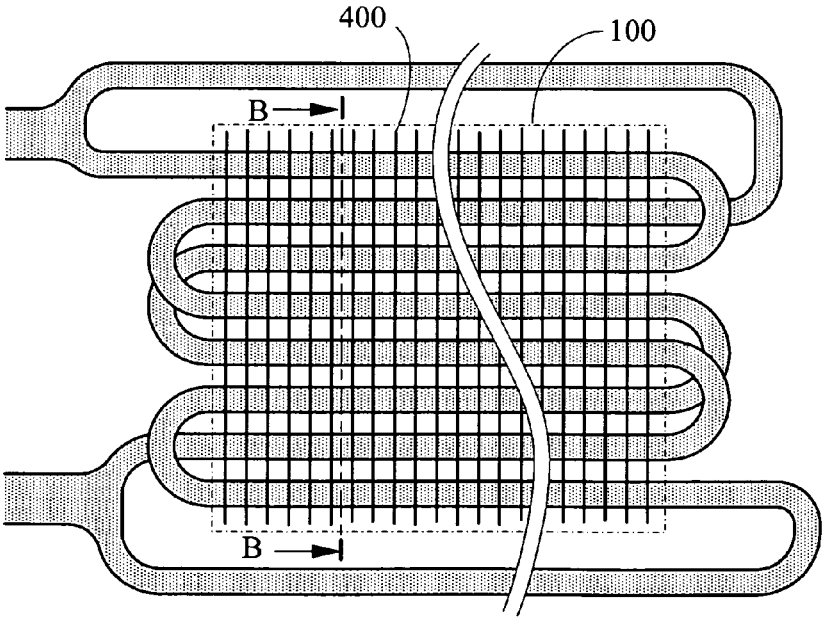
FIG. 24 is a structural schematic view of the embodiment shown in FIG. 15 showing that a common thermal conductive plate is additionally installed between the neighboring fluid piping and the first fluid piping and/or the second fluid piping.

FIG. 24 is a structural schematic view of such an embodiment shown in FIG. 15 showing that a common thermal conductive plate is additionally installed between the neighboring fluid piping and the first fluid piping and/or the second fluid piping.

Figure 25:
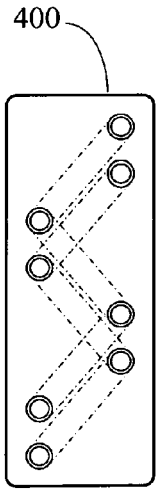
FIG. 25 is a sectional drawing of line B-B in FIG. 24.

FIG. 25 is a sectional drawing of line B-B in FIG. 24.

As the embodiment of the heat absorbing or dissipating device having the multi-pipe structure configured to reversely transport fluids having different temperatures as shown in FIG. 15, in order to give consideration to structure stability, process, and the need for functionality of independent temperature guiding, the thermal conductive plate (350) with temperature insulating slots further can be additionally installed between the neighboring fluid piping and the first fluid piping (101) and/or the second fluid piping (102) to increase heat absorption or dissipation area and enhance structure stability.

Figure 26:
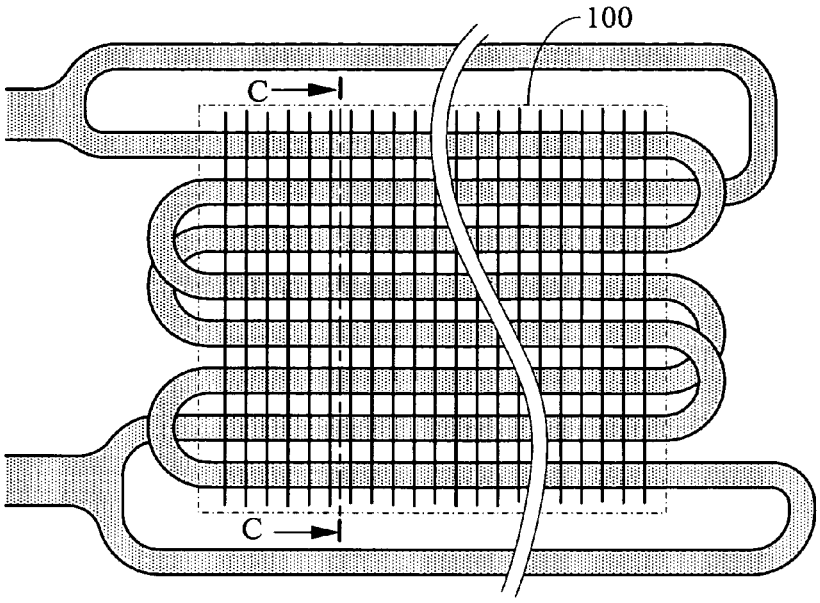
FIG. 26 is a structural schematic view of the embodiment shown in FIG. 15 showing that a thermal conductive plate with temperature insulating slots is additionally installed between the neighboring fluid piping and the first fluid piping and/or the second fluid piping.

FIG. 26 is a structural schematic view of such an embodiment shown in FIG. 15 showing that a thermal conductive plate with temperature insulating slots is additionally installed between the neighboring fluid piping and the first fluid piping and/or the second fluid piping.

Figure 27:
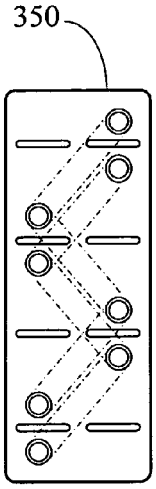
FIG. 27 is a sectional drawing of line C-C in FIG. 26.

FIG. 27 is a sectional drawing of line C-C in FIG. 26.

As the embodiment of the heat absorbing or dissipating device having the multi-pipe structure configured to reversely transport fluids having different temperatures, the fluid passing through the first fluid piping (101) and/or the thermal conductive fluid passed and passively receiving heat absorbing or dissipating tubular structure body (100') can be controlled by control device (500) to drive two-way movement of fluid pumping device (600) for periodic forward/reverse pumping operation, to periodically pump the thermal conductive fluid (110) in forward and reverse direction, and to improve the effects of uniform temperature.

The above two-way movement of fluid pumping device (600) is used for periodic forward/reverse pumping under the control of control device composed of electromechanical device, electronic device, or microcomputer and related software.

Figure 28:
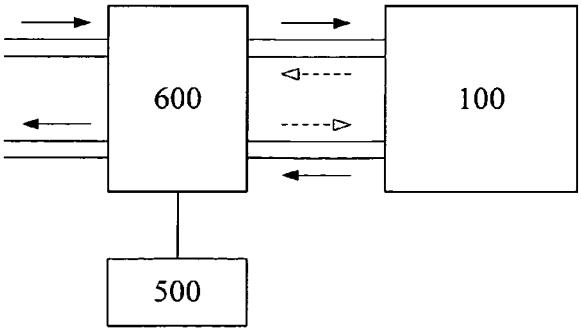
FIG. 28 is a block diagram of a periodic forward/reverse pumping system, according to the present invention.

FIG. 28 is a block diagram of a periodic forward/reverse pumping system, according to the present invention. For applications of the heat absorbing or dissipating device having the multi-pipe structure configured to reversely transport fluids having different temperatures, one or more of the following methods based on the aforementioned operating principles according to the structural needs and cost can be used to make the following designs, including:

For the heat absorbing or dissipating device having the multi-pipe structure configured to reversely transport fluids having different temperatures, the first fluid piping (101) and the second fluid piping (102) can be configured to have an integral piping structure integrally formed with the structure of the heat absorbing or dissipating body (100);

For the heat absorbing or dissipating device having the multi-pipe structure configured to reversely transport the fluids, the three piping structures of the first fluid piping (101), second fluid piping (102) and heat absorbing or dissipating body (100) can be formed as an assembled structure;

For the heat absorbing or dissipating device having the multi-pipe structure configured to reversely transport the fluids, the heat absorbing or dissipating body (100) can have a single structural body in plate, block, or multi-fins shape, or the structural unit assembled by fins;

For the heat absorbing or dissipating device having the multi-pipe structure configured to reversely transport the fluids, the three of the heat absorbing or dissipating body (100) can be formed from solid, or colloid, or liquid, or gaseous state thermal conductive materials, and the first fluid piping (101) and the second fluid piping (102) can be made in various geometric shapes without changing the principles of operation;

For the heat absorbing or dissipating device having the multi-pipe structure configured to reversely transport the fluids, the thermal conductive fluid (110) passing through the first fluid piping (101) and the second fluid piping (102) can be transported by pumping, evaporation, or heat-cold natural circulation;

For the heat absorbing or dissipating device having the multi-pipe structure configured to reversely transport the fluids, the warming or cooling energy is discharged to the liquid state passively to a heat dissipation or absorption receiving article or space (200) by using a flow that results naturally from a cold-heat circulation of fluid having a temperature difference or forced fluid pumping to generate a thermal transfer function of heat convention, radiation or conduction; or the warming or cooling energy is discharged to the solid or colloidal or liquid or gaseous state passive heat dissipation or absorption receiving article or space (200) through conduction;

For the heat absorbing or dissipating device having the multi-pipe structure configured to reversely transport the fluids, the thermal conductive fluid (110) passing through the first fluid piping (101) and the second fluid piping (102) is circulated through a closed-loop structure or released by an open-loop structure;

For the heat absorbing or dissipating device having the multi-pipe structure configured to reversely transport the fluids, the fluid inlets and the fluid outlets of the various fluid piping can be installed in the same or different pointing direction within three-dimensional space; and For the heat absorbing or dissipating device having the multi-pipe structure configured to reversely transport the fluids, there are various installation modes of the fluid piping, including that the fluid piping is composed of a tubular structure; and/or the fluid piping is composed of plate sheet structure for fluid flow; and/or the pore-like fluid piping is composed of blocky structure for fluid flow. The heat absorbing or dissipating device with multi-pipe reversely transported temperature difference fluids of the present invention can be applied for various heat absorbing, or dissipating, or cooling heat conducting application devices, such as the cooling water radiators of the engine, heat absorbing devices using thermal conductive fluid, or heat dissipating devices using thermal conductive fluid such as thermal energy, heater or thermal energy transfer devices for warming equipments, or heating or cooling for ceilings, walls or floors of the buildings, or cooling of photovoltaic panels, or heating or cooling for electrical machine or power machineries, or heat absorption and dissipation of various machine casings, heat pipe structures, structure casings, various chips or semiconductor components, ventilation devices, or the heat absorption, heat dissipation or thermal energy transfer of information, audio or image devices, or heat dissipation of various lamp or LED devices, or the heat absorption of the evaporator or heat dissipation or thermal energy transfer of condensers of air conditioning devices, or thermal energy transfer of mechanical devices, or heat dissipation of frictional heat loss, or heat dissipation or thermal energy transfer of electric heater or other electric heating home appliances or cooking devices, or heat absorption or thermal energy transfer of flame heating stoves or cooking devices, or heat absorption, heat dissipation or thermal energy transfer of earth layer or water thermal energy, plant or housing building or building material or building structure devices, heat absorbing or dissipation of water tower, or heat absorption, heat dissipation or thermal energy transfer of batteries of fuel cells, etc.;

As well as applied for thermal energy transfer in home appliances, industrial products, electronic products, electrical machines or mechanical devices, power generation equipments, buildings, air conditioning devices, industrial equipments or industrial manufacturing process.

The invention claimed is:

1. A heat absorbing or dissipating device comprising:

a passive heat dissipation or absorption receiving article or space having at least one heat absorbing or dissipating body having a first side and a second opposite side, wherein the heat absorbing or dissipating body has an inlet manifold having a first and second outlet on a same end of the first side and an outlet manifold on an opposite end of the first side than the inlet manifold, said outlet manifold having a first and second inlet on a same end of the first side of the heat absorbing or dissipating body;

at least one first fluid piping coupled to the first outlet of the inlet manifold coupled to the second opposite side of the heat absorbing or dissipating body and to the first inlet of the outlet manifold coupled to the first side to form at least one first circuit within the heat absorbing or dissipating body;

at least one second fluid piping coupled to the second outlet of the inlet manifold coupled to the first side of the heat absorbing or dissipating body and to the second inlet of the outlet manifold coupled to the second opposite side of the heat absorbing or dissipating body to form at least one second circuit within the heat absorbing or dissipating body, wherein the at least one first and second circuits are configured in a way such that a thermal conductive fluid is flowable in the heat absorbing or dissipating body such that a flow through at least one first circuit is in one direction and the flow in the at least one second circuit is in a parallel and opposite direction to the one direction.

2. The heat absorbing or dissipating device as claimed in claim 1, wherein the heat absorbing or dissipating device further comprises at least one of: a common thermal conductive plate configured to connect neighboring fluid piping of the at least one first and second fluid piping; an independent thermal conductive plate configured to not connect with neighboring fluid piping of the at least one first and second fluid piping; and a thermal conductive plate comprising temperature insulating slots configured to be connected between neighboring fluid piping of the at least one first and second fluid piping.

3. The heat absorbing or dissipating device as claimed in claim 1, wherein the fluid passing through the first circuit and/or the fluid passing through the passive heat absorbing or dissipating device is controlled by a control device configured to control a fluid direction of the flow in the first and/or second circuit and operable to periodically change the fluid flow direction of the flow in the first and/or second circuit.

4. The heat absorbing or dissipating device as claimed in claim 1, wherein the at least one first fluid piping and the at least one second fluid piping is integrally formed with the heat absorbing or dissipating body.

5. The heat absorbing or dissipating device as claimed in claim 1, wherein the at least one first fluid piping and the at least one second fluid piping is formed with the heat absorbing or dissipating body as an assembled structure.

6. The heat absorbing or dissipating device as claimed in claim 1, wherein the heat absorbing or dissipating body can be formed from at least one single structural body selected from the group consisting of a plate, a block, multi-fin structure, and a structural unit assembled with fins.

7. The heat absorbing or dissipating device as claimed in claim 1, wherein the at least one first fluid piping, the at least one second fluid piping, and the heat absorbing or dissipating body, or combinations thereof can be formed into various geometric shapes.

8. The heat absorbing or dissipating device as claimed in claim 1, wherein the fluid passing through the first and second circuit is transported by pumping, evaporation, or heat-cold natural circulation.

9. The heat absorbing or dissipating device as claimed in claim 1, wherein the heat transference to the passively heat dissipation or absorption receiving article or space is through cold-heat natural circulation of the thermal conductive fluid having a temperature difference or forced fluid pumping to generate thermal transference of heat by heat convention, radiation or conduction.

10. The heat absorbing or dissipating device as claimed in claim 1, wherein the thermal conductive fluid passing through the at least one first fluid piping and the at least one second fluid piping flows in a closed-loop or in an open-loop system.

11. The heat absorbing or dissipating device as claimed in claim 1, wherein the fluid inlets and the fluid outlets of the at least one first and second circuits are installed in a same or different pointing direction within a three-dimensional space.

12. The heat absorbing or dissipating device as claimed in claim 1, wherein the at least one first and second fluid flow piping are: tubes; and/or a plate sheet structure for fluid flow; and/or the a block structure for fluid flow.

* * * * *